US007496304B2

(12) United States Patent
Okano et al.

(10) Patent No.: US 7,496,304 B2
(45) **Date of Patent: *Feb. 24, 2009**

(54) COLOR IMAGE FORMING APPARATUS AND COLOR IMAGE FORMING METHOD HAVING OVERLAPPING TONERS

(75) Inventors: Yoshiaki Okano, Mishima (JP); Masatsugu Hirayama, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/677,415

(22) Filed: Feb. 21, 2007

(65) Prior Publication Data

US 2007/0134011 A1 Jun. 14, 2007

Related U.S. Application Data

(63) Continuation of application No. 10/994,245, filed on Nov. 23, 2004, now Pat. No. 7,233,748.

(30) Foreign Application Priority Data

Nov. 28, 2003 (JP) ..... 2003-400874

(51) Int. Cl.
*G03G 15/00* (2006.01)

(52) U.S. Cl. ..... 399/45

(58) Field of Classification Search ..... 399/38, 399/39, 45, 66, 67, 69

See application file for complete search history.

(56) References Cited

U.S. PATENT DOCUMENTS

| | | | | |
|---|---|---|---|---|
| 6,327,444 | B1 | 12/2001 | Hachisuga | |
| 6,434,345 | B2 | 8/2002 | Watanabe | |
| 6,804,481 | B2 * | 10/2004 | Mochizuki et al. | 399/66 |
| 6,965,750 | B2 | 11/2005 | Muratani | |
| 7,233,748 | B2 * | 6/2007 | Okano et al. | 399/45 |
| 2004/0264992 | A1 | 12/2004 | Shiraishi | |
| 2005/0191076 | A1 * | 9/2005 | Dan | 399/70 |
| 2008/0002997 | A1 * | 1/2008 | Watanabe et al. | 399/35 |

FOREIGN PATENT DOCUMENTS

JP 9-304979 A 11/1997

* cited by examiner

*Primary Examiner*—Hoan H Tran
(74) *Attorney, Agent, or Firm*—Foley & Lardner LLP

(57) ABSTRACT

In a digital copying machine according to an image forming apparatus of the invention, when a "thick paper" mode is set through an operation panel, a main CPU sets a gradient of γ for "thick paper" in a γ correction unit of an image processing unit. Thus, a toner attachment amount is controlled and changed from 1.6 mg/cm$^2$ to 1.0 mg/cm$^2$, thereby widening a fixation temperature range for good fixation.

7 Claims, 4 Drawing Sheets

COLOR IMAGE FORMING APPARATUS AND COLOR IMAGE FORMING METHOD HAVING OVERLAPPING TONERS

CROSS-REFERENCE TO RELATED APPLICATIONS

The present application is a continuation of U.S. application Ser. No. 10/994,245, filed Nov. 23, 2004, which is based upon and claims the benefit of priority from prior Japanese Patent Application No. 2003-400874, filed Nov. 28, 2003, the entire contents of which are incorporated herein by reference.

BACKGROUND OF THE INVENTION

1. Field of the Invention

The present invention relates to an image forming apparatus, such as an electrophotographic apparatus, which forms a color image by overlapping a plurality of color toners, and to an image forming method.

2. Description of the Related Art

In a fixing device of a conventional electrophotographic image forming apparatus, a fixation temperature range for good fixation on thick paper is narrower than a fixation temperature range for good fixation on ordinary paper.

In addition, while paper is being passed through the fixing device, a temperature variation range of a heat roller is greater when thick paper is passed than when ordinary paper is passed. Consequently, a low-temperature-side offset tends to easily occur. Jpn. Pat. Appln. KOKAI Publication No. 09-304979, for instance, discloses a structure for varying image formation conditions depending on characteristics of paper.

As described above, in the fixing device of the electrophotographic image forming apparatus, the fixation temperature range for good fixation on thick paper is narrower than that for good fixation on ordinary paper. In addition, the temperature variation range of the heat roller is greater when thick paper is passed than when ordinary paper is passed. Consequently, a low-temperature-side offset tends to easily occur. Moreover, when thick paper is used, the temperature control for the fixing device is difficult, and a great deal of time is needed to achieve a desired uniform temperature. As a result, the productivity for copying considerably deteriorates.

BRIEF SUMMARY OF THE INVENTION

The object of an aspect of the present invention is to provide an image forming apparatus and an image forming method, which can increase a fixation temperature range for good fixation even when thick paper is used and can prevent occurrence of low-temperature-side offset.

According to an aspect of the present invention, there is provided an image forming apparatus that forms a color image by overlapping toners of a plurality of colors, on the basis of a plurality of image data corresponding to the plurality of colors, the apparatus comprising: setting means for setting a thick paper mode in which an image is to be formed on thick paper, in contrast to an ordinary paper mode in which an image is to be formed on ordinary paper, on the basis of the plurality of image data corresponding to the plurality of colors; and control means for executing, when the thick paper mode is set by the setting means, a control to reduce a maximum toner attachment amount, compared to the ordinary paper mode, and to set the same fixation temperature condition as in the ordinary paper mode, wherein the control means executes, when γ correction is performed for the image data of each color, a control to change a γ correction value for the ordinary paper mode to a γ correction value for the thick paper mode, thereby reducing the maximum toner attachment amount of each color.

According to another aspect of the present invention, there is provided an image forming method for an image forming apparatus that forms a color image by overlapping toners of a plurality of colors, on the basis of a plurality of image data corresponding to the plurality of colors, the method comprising: executing, when a thick paper mode in which an image is to be formed on thick paper is set in contrast to an ordinary paper mode in which an image is to be formed on ordinary paper on the basis of the plurality of image data corresponding to the plurality of colors, a control to reduce a maximum toner attachment amount, compared to the ordinary paper mode, and to set the same fixation temperature condition as in the ordinary paper mode; and executing, when γ correction is performed for the image data of each color, a control to change a γ correction value for the ordinary paper mode to a γ correction value for the thick paper mode, thereby reducing the maximum toner attachment amount of each color.

Additional objects and advantages of an aspect of the invention will be set forth in the description which follows, and in part will be obvious from the description, or may be learned by practice of the invention. The objects and advantages of an aspect of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of an aspect of the invention.

DETAILED DESCRIPTION OF THE INVENTION

An embodiment of the present invention will now be described with reference to the accompanying drawings.

Figure 1:
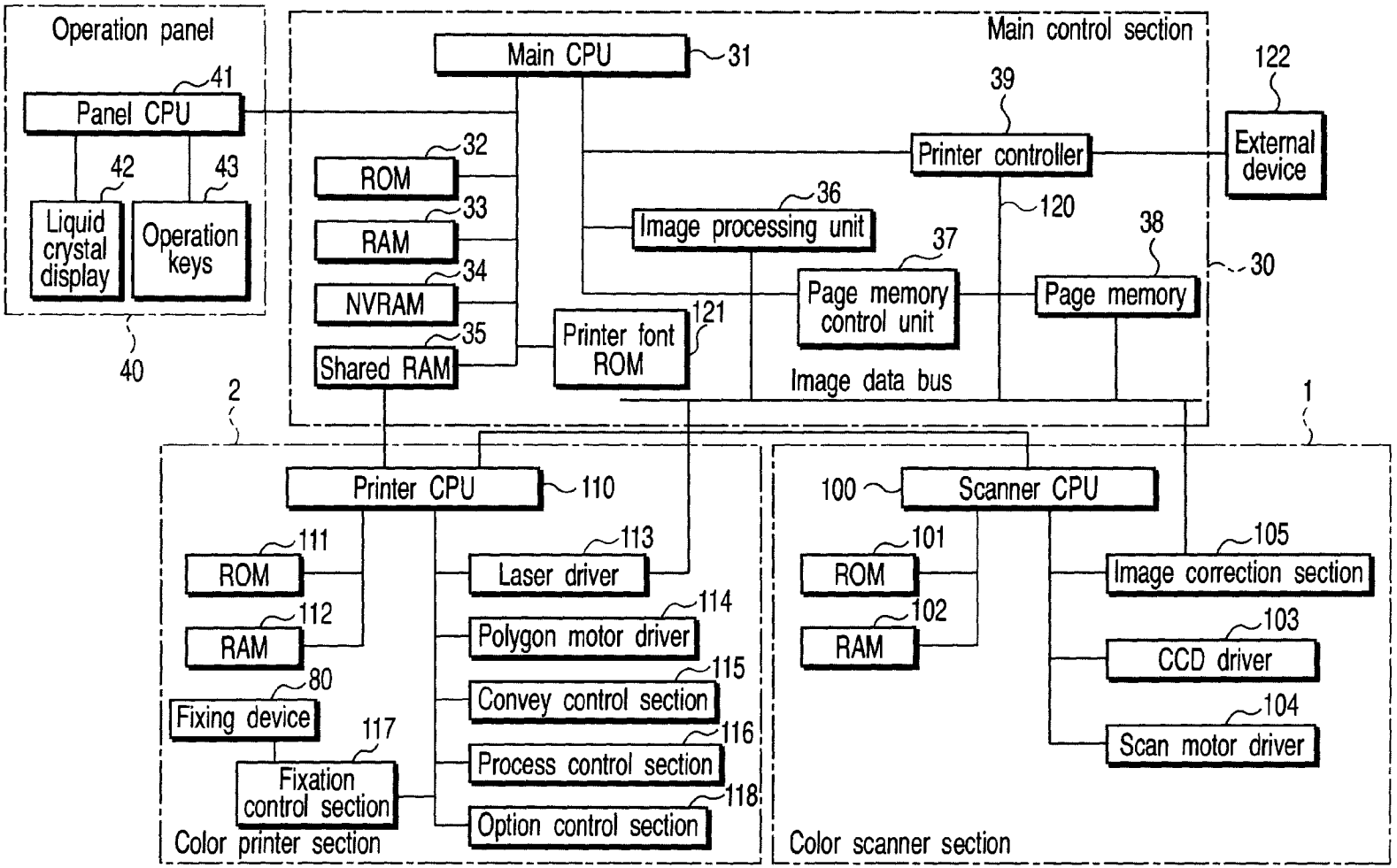
FIG. 1 is a block diagram that schematically shows the structure of a digital copying machine, to which an embodiment of the invention is applicable.

FIG. 1 schematically shows the structure of a digital color copying machine according to the image forming apparatus of the present invention. The image forming apparatus comprises a color scanner section 1, a color printer section 2, a main control section 30 and an operation panel 40.

In FIG. 1, a control system comprises three CPUs (Central Processing Units): a main CPU 31 provided in the main control section 30; a scanner CPU 100 in the color scanner section 1; and a printer CPU 110 in the color printer section 2.

The operation panel 40 comprises a liquid crystal display 42, various operation keys 43, and a panel CPU 41 to which these are connected. The operation panel 40 is connected to the main CPU 31. As will be described later in detail, a "thick paper" mode for forming an image on thick paper, in contrast to image formation on ordinary paper, can be set through the operation panel 40.

The main CPU 31 executes an overall control. A ROM 32 stores control programs, etc. A RAM 33 temporarily stores data.

A page memory control unit 37 stores and reads out image information in and from a page memory 38.

The color scanner section 1 comprises the scanner CPU 100 for executing an overall control; a ROM 101 storing control programs, etc.; a data storage RAM 102; a CCD driver 103 for driving a color image sensor (not shown); a scan motor driver 104 for controlling the rotation of a scan motor for moving a first carriage (not shown), etc.; and an image correction section 105 that executes image correction.

The color printer section 2 comprises the printer CPU 110 for executing an overall control; a ROM 111 storing control programs, etc.; a data storage RAM 112; a laser driver 113 for driving a semiconductor laser (not shown); a polygon motor driver 114 for driving a polygon motor of an exposure device (not shown); a convey control section 115 for controlling conveyance of paper P by a convey mechanism (not shown); a process control section 116 for controlling charging, developing and transferring processes using a charging device, a developing roller and a transfer device (not shown); and a fixation control section 117 for controlling a fixing device 80 (to be described later in detail).

The image processing unit 36, page memory 38, printer controller 39, image correction section 105 and laser driver 113 are connected over an image data bus 120.

Figure 2:
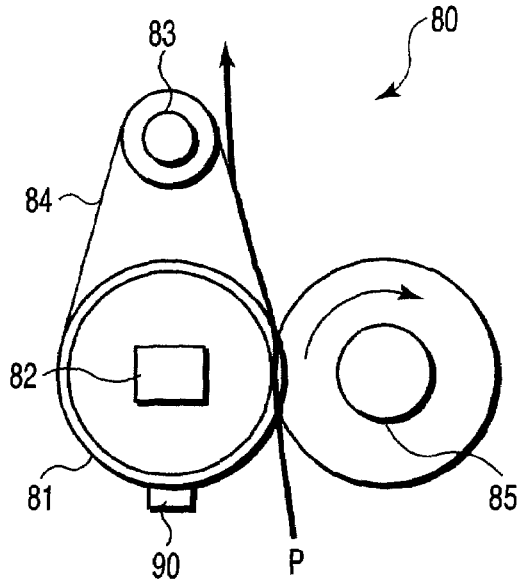
FIG. 2 schematically shows the structure of a fixing device that is provided in a color printer section.

FIG. 2 schematically shows the structure of the fixing device 80 that is provided in the color printer section 2. The fixing device 80 comprises a heat roller 81 that includes a heater 82; a fixing belt 84 that is passed between the heat roller 81 and a separation member 83; and a press roller 85 that is put in pressure contact with the heat roller 81 via the fixing belt 84, thereby creating a nip.

A thermistor 90 is provided near the heat roller 81. Based on temperature detection by the thermistor 90, the printer CPU 110 executes a temperature control for the heat roller 81 through the fixation control section 117.

Figure 3:
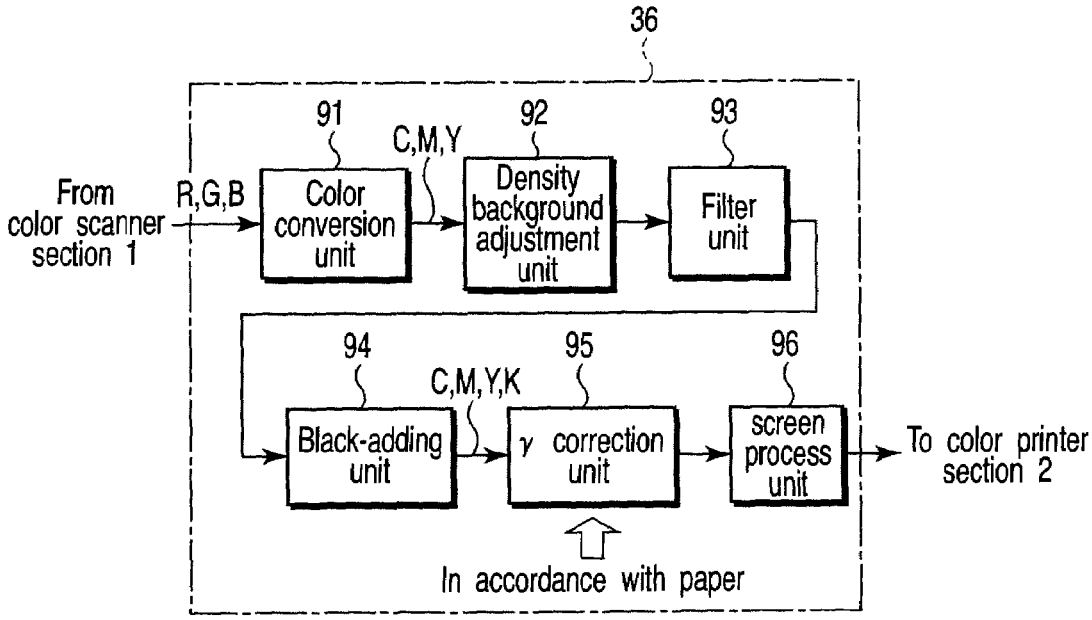
FIG. 3 schematically shows the structure of an image processing unit.

FIG. 3 schematically shows the structure of the image processing unit 36 that is provided in the main control section 30. The image processing unit 36 comprises a color conversion unit 91, a density background adjustment unit 92, a filter unit 93, a black-adding unit 94, a γ correction unit 95, and a screen process unit 96.

In FIG. 3, image data R (red), G (green) and B (blue), which is output from the color scanner section 1, is input to the color conversion unit 91 in the image processing unit 36.

The color conversion unit 91 converts the input image data R, G, B to color signals of C (cyan), M (magenta) and Y (yellow). The CMY color signals, which are output from the color conversion unit 91, are sent to the density background adjustment unit 92.

The density background adjustment unit 92 adjusts the density background in the input CMY color signals. The CMY color signals, which are output from the density background adjustment unit 92, are delivered to the filter unit 93.

The filter unit 93 executes a filtering process for the input CMY color signals. The CMY color signals, which are output from the filter unit 92, are delivered to the black-adding unit 94.

The black-adding unit 94 generates a K (black) signal on the basis of the input CMY signals. In the case of color printing, if inks of three colors, i.e. CMY, are used, gray that is close to black would be produced. In order to print a black part as an exact black pixel, the signal (K) for the black part is generated. The CMYK signals, which are output from the black-adding unit 94, are sent to the γ correction unit 95.

The γ correction unit 95, as will be described later in detail, executes γ correction for the input CMYK signals. The γ-corrected CMYK signals, which are output from the γ correction unit 95, are sent to the screen process unit 96.

The screen process unit 96 subjects the input CMYK signals to a process, such as an error diffusion process, in accordance with a recordable bit-number of the color printer section 2. The CMYK signals, which are output from the screen process unit 96, are sent to the color printer section 2.

Next, the present invention with the above structure is described.

In the prior art, in this kind of fixing device, the fixation temperature range for good fixation on thick paper is narrower than that for good fixation on ordinary paper. In addition, while paper is being passed through the fixing device, a temperature variation range of the heat roller is greater when thick paper is passed than when ordinary paper is passed. Consequently, a low-temperature-side offset tends to easily occur.

Figure 4:
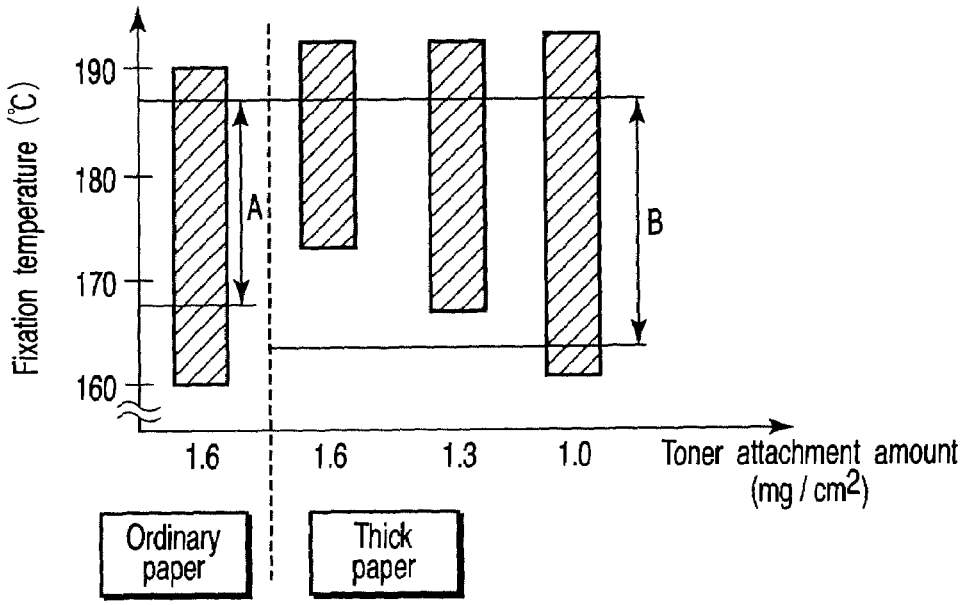
FIG. 4 illustrates good-fixation temperature ranges in relation to toner attachment amounts when colors are overlapped on ordinary paper and on thick paper.

FIG. 4 illustrates good-fixation temperature ranges in relation to toner attachment amounts when colors are overlapped on ordinary paper and on thick paper.

As is shown in FIG. 4, a good-fixation temperature range (hatched area) for ordinary paper in relation to the toner attachment amount of 1.6 mg/cm$^2$ is 160° C. to 190° C. A temperature variation range A of the fixing device 80 for ordinary paper is 168° C. to 187° C. and falls within the good-fixation temperature range.

On the other hand, a good-fixation temperature range (hatched area) for thick paper in relation to the toner attachment amount of 1.6 mg/cm$^2$ is 172° C. to 192° C. A temperature variation range B of the fixing device 80 for thick paper is 163° C. to 187° C. and, as a result, an offset occurs on a low-temperature side in the good-fixation temperature range.

In the present invention, as shown in FIG. 4, when thick paper is used, the toner attachment amount is controlled and changed from 1.6 mg/cm$^2$ to 1.0 mg/cm$^2$. Thereby, the good-fixation temperature range is increased to 160° C. to 193° C., and the temperature variation range B can fully be covered.

Figure 5:
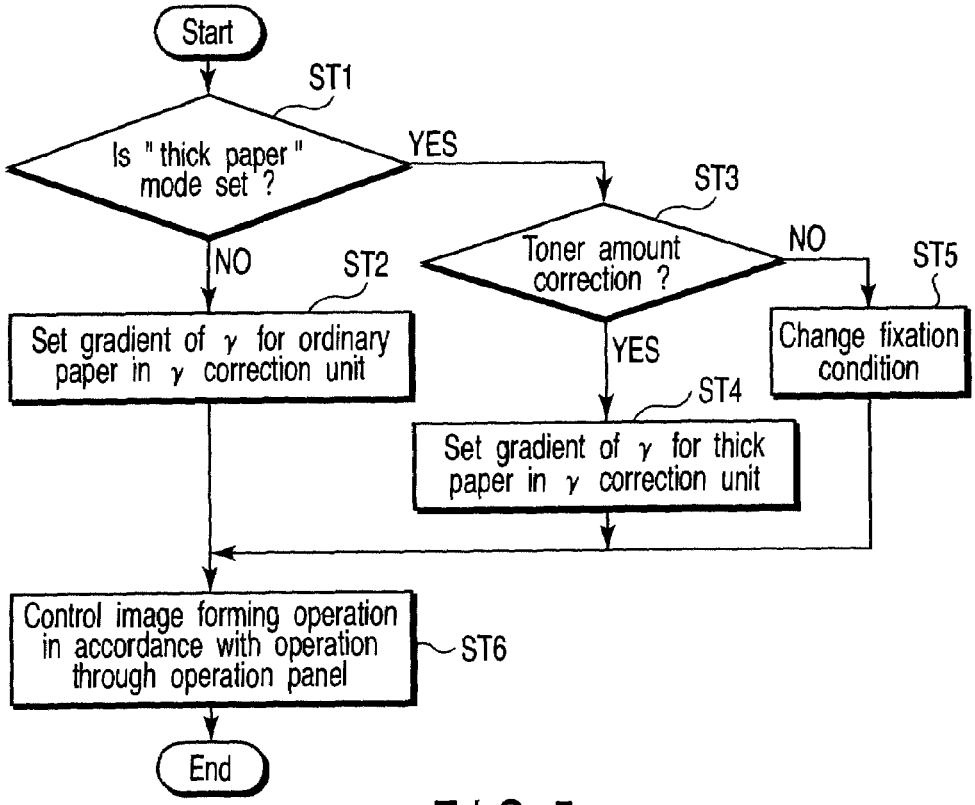
FIG. 5 is a flow chart illustrating the image forming operation of the digital copying machine.

Next, referring to a flow chart of FIG. 5, the image forming operation of the digital copying machine is described.

To start with, the main CPU 31 confirms whether the "thick paper" mode is set through the operation panel 40 (ST1).

In step ST1, if the "thick paper" mode is not set, the main CPU 31 sets a γ curve for ordinary paper in the γ correction unit 95 (ST2).

Figure 6:
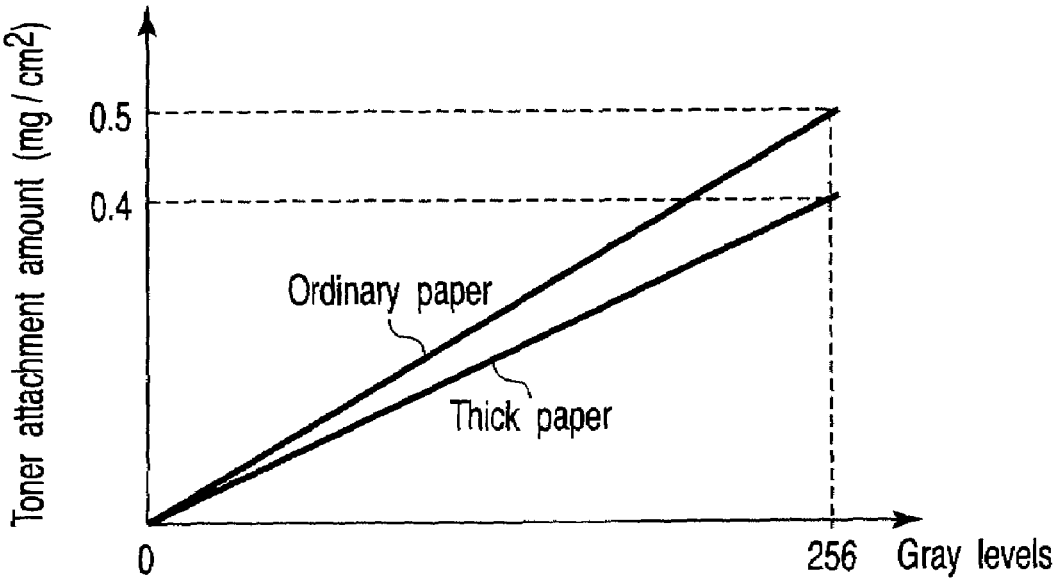
FIG. 6 shows γ curves of a single color when ordinary paper and thick paper are used.

FIG. 6 shows γ curves of a single color for ordinary paper and thick paper. As is shown in FIG. 6, a "γ" of a correction curve is set such that the toner attachment amount is 0.5 mg/cm$^2$ with 256 gray levels.

In step ST1, if the "thick paper" mode is set, the main CPU 31 confirms whether the toner amount is to be corrected or not (ST3).

If the toner amount correction is performed in step ST3, the main CPU 31 sets the gradient of γ for thick paper in the γ correction unit 95 (ST4). As is shown in FIG. 6, a "γ" of a correction curve is set such that the toner attachment amount is 0.4 mg/cm$^2$ with 256 gray levels.

In step ST3, if the toner amount correction is not to be performed, the main CPU 31 changes the fixation temperature setting condition (ST5).

The main CPU 31 controls the image forming operation in accordance with an operation through the operation panel 40 (ST6).

In the above-described embodiment, the "thick paper" mode is set in contrast to the ordinary paper mode. Alternatively, finer setting modes, such as "thick paper mode 1" and "thick paper mode 2", may be set in contrast to ordinary paper. For example, a thick paper mode 1 is set for thick paper with a basis weight of 106 g to 163 g, and a thick paper mode 2 is set for thick paper with a basis weight of 164 g to 209 g.

The toner attachment amount at the time of setting the thick paper mode may be adjusted from the default value by the user through the operation panel 40.

As has been described above, according to the embodiment of the present invention, a high-quality image with no fixation defect can be obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus that forms a color image by overlapping toners of a plurality of colors, on the basis of a plurality of image data corresponding to the plurality of colors, the apparatus comprising:

setting means for setting a thick paper mode in which an image is to be formed on thick paper, in contrast to an ordinary paper mode in which an image is to be formed on ordinary paper, on the basis of the plurality of image data corresponding to the plurality of colors; and γ correction means for subjecting the plurality of image data to γ correction based on a γ correction value;

image forming means for forming an image based on the image data subjected to the γ correction; and control means for executing a control to change a γ correction value for the ordinary paper mode to a γ correction value for the thick paper mode, to thereby reduce a maximum toner attachment amount of each of the toners of the plurality of toners, and set the same fixation temperature condition as in the ordinary paper mode.

2. The image forming apparatus according to claim 1, wherein the control means executes a control to change a transfer bias for the ordinary paper mode to a transfer bias for the thick paper mode, thereby reducing the maximum toner attachment amount for the image forming means.

3. The image forming apparatus according to claim 1, wherein the control means further changes a default value for reducing the maximum toner attachment amount for the image forming means in the thick paper mode.

4. The image forming apparatus according to claim 1, wherein the control means changes a correction curve for the image data of each color, with which the toner attachment amount is a first predetermined amount with 256 gray levels of each color in the ordinary paper mode, to a correction curve for the image data of each color, with which the toner attachment amount is a second predetermined amount less than the first predetermined amount with 256 gray levels of each color in the thick paper mode.

5. The image forming apparatus according to claim 1, wherein when the ordinary paper mode is set, the control means sets a γ correction value for the ordinary paper mode, in the γ correction means.

6. The image forming apparatus according to claim 1, wherein when the ordinary paper mode is set, and a toner amount correction is performed, the control means causes a main CPU to set a gradient of γ of the γ correction means with respect to the thick paper.

7. The image forming apparatus according to claim 1, wherein when the thick paper mode is set, and a toner amount correction is not performed, the control means causes a main CPU to change conditions for setting a fixation temperature of the image forming means.

* * * * *